US009821936B1

(12) United States Patent
Arriaga

(10) Patent No.: US 9,821,936 B1
(45) Date of Patent: Nov. 21, 2017

(54) BOTTLE CAP WITH INTEGRATED BOTTLE OPENER

(71) Applicant: Huitzilo Arriaga, Santa Ana, CA (US)

(72) Inventor: Huitzilo Arriaga, Santa Ana, CA (US)

( * ) Notice: Subject to any disclaimer, the term of this patent is extended or adjusted under 35 U.S.C. 154(b) by 106 days.

(21) Appl. No.: 14/824,743

(22) Filed: Aug. 12, 2015

(51) Int. Cl.
*B65D 51/00* (2006.01)
*B65D 51/24* (2006.01)
*B67B 7/16* (2006.01)
*B65D 41/02* (2006.01)

(52) U.S. Cl.
CPC ..... *B65D 51/243* (2013.01); *B65D 41/02* (2013.01); *B67B 7/16* (2013.01)

(58) Field of Classification Search
CPC ..... B65D 39/14; B65D 39/16; B65D 51/243; B65D 47/0833; B65D 47/08; B67B 7/18
USPC ..... 215/226
See application file for complete search history.

(56) References Cited

U.S. PATENT DOCUMENTS 757,548 A * 4/1904 Goodrich ..... B65D 51/243 215/226
952,085 A * 3/1910 Stephens ..... B65D 51/243 215/226
1,341,163 A * 5/1920 Beste ..... B67B 7/16 53/341
1,725,726 A * 8/1929 Cotton ..... B67B 7/16 206/217
1,916,115 A * 6/1933 Perkins ..... B67B 7/16 215/303
2,020,205 A * 11/1935 Perkins ..... B67B 7/16 215/226
2,347,734 A * 5/1944 Cowan, Jr. ..... B67B 7/16 81/3.15
2,447,146 A * 8/1948 Vogel ..... B65D 51/243 215/226
D172,571 S * 7/1954 Ward ..... 81/3.09
2,682,985 A * 7/1954 Colonna ..... B67B 3/02 53/363
2,754,821 A * 7/1956 Burbig ..... A61H 35/02 604/298
3,236,126 A * 2/1966 Martinmaas ..... B65D 1/0269 215/304
3,272,369 A * 9/1966 Kjellsen Grimsley Arvid ..... B65D 41/0407 215/329
3,300,074 A * 1/1967 Heubl ..... B65D 51/243 215/226

(Continued)

OTHER PUBLICATIONS

Examiner search results from related design U.S. Appl. No. 29/535,997.

(Continued)

*Primary Examiner* — Anthony Stashick
*Assistant Examiner* — Ernesto Grano
(74) *Attorney, Agent, or Firm* — Steve Reiss; ScienBiziP, P.C.

(57) ABSTRACT

A bottle cap includes a cap body for covering an opening of a bottle. A bottle opener is integrally formed into the cap body for removing a crimped, twist-off or pop-off type cap from another bottle. The cap body includes an outer surface and the bottle opener is formed as a groove in a portion of the outer surface. The bottle cap need not be removed to access the bottle opener and the cap may be removed from another bottle while cap body is covering the opening of its associated bottle.

12 Claims, 9 Drawing Sheets

(56) References Cited

U.S. PATENT DOCUMENTS 3,542,231 A * 11/1970 Wettermann ..... B65D 41/185 215/226
3,736,817 A * 6/1973 Huff ..... B65D 41/026 7/151
3,812,741 A * 5/1974 Heine ..... B67B 7/18 7/151
3,997,077 A * 12/1976 Mill ..... B01L 3/50825 215/329
4,103,798 A * 8/1978 Moeller ..... B65D 41/02 215/200
4,403,712 A * 9/1983 Wiesinger ..... B65D 43/162 16/225
4,433,597 A * 2/1984 Rowland ..... B67B 7/16 7/151
D278,517 S 4/1985 Milin
4,580,303 A * 4/1986 Henshaw ..... B67B 7/44 215/226
D284,553 S * 7/1986 Collister ..... D9/435
4,598,435 A * 7/1986 Borodulin ..... B65D 41/026 215/322
4,642,827 A * 2/1987 Karuzas ..... B67B 7/44 431/253
5,022,288 A * 6/1991 Taktakian ..... B67B 7/18 81/3.4
5,109,997 A * 5/1992 Phillips ..... B65D 39/12 215/358
D339,274 S * 9/1993 Alpers ..... D8/43
5,301,837 A * 4/1994 O'Meara ..... B65D 35/22 222/541.2
D358,311 S * 5/1995 Sarnoff ..... D8/34
5,464,110 A * 11/1995 Heyworth ..... B65D 41/04 215/223
5,791,505 A * 8/1998 Gilliland ..... B65D 51/24 215/228
D399,108 S * 10/1998 Koefelda ..... D2/869
6,179,138 B1 * 1/2001 Puleston ..... B65D 39/16 215/226
6,212,721 B1 * 4/2001 Borodulin ..... B65D 41/026 215/322
D466,381 S * 12/2002 Joseph ..... D8/18
D476,568 S * 7/2003 Mechtold ..... D24/120
D477,215 S * 7/2003 Mechtold ..... D9/699
7,296,498 B1 * 11/2007 Kim ..... B65D 41/12 81/3.15
D558,978 S * 1/2008 Roesler ..... D3/282
7,346,958 B2 * 3/2008 Parsons ..... F41B 15/022 16/110.1
7,404,345 B1 * 7/2008 Dipprey ..... B67B 7/16 81/3.09
D606,862 S * 12/2009 Mora-Hernandez ..... D9/449
D628,893 S * 12/2010 Groubert ..... D9/449
D653,512 S 2/2012 Frazier
D684,448 S * 6/2013 Delgado ..... D8/34
8,720,714 B2 5/2014 Romero
D726,007 S * 4/2015 Beth-Jacob ..... D9/436
9,073,672 B2 * 7/2015 Laperriere ..... B65D 41/02
D736,046 S * 8/2015 Crane ..... D8/38
9,242,841 B1 * 1/2016 Appleby ..... B67B 7/18
2002/0175169 A1 * 11/2002 Tham-Itthisak ... A47G 19/2205 220/600
2005/0035080 A1 * 2/2005 Romero ..... B67B 7/403 215/228
2007/0074604 A1 * 4/2007 Lipson ..... B67B 7/16 81/3.15
2008/0023433 A1 * 1/2008 Romero ..... B67B 7/18 215/304
2008/0098853 A1 5/2008 Choate
2008/0223812 A1 * 9/2008 Domagala ..... B65D 39/0076 215/230
2008/0296249 A1 12/2008 Lockerman
2009/0133537 A1 * 5/2009 Uglum ..... B67B 7/16 81/3.37
2009/0145267 A1 * 6/2009 Moles ..... B67B 7/18 81/3.37
2011/0006061 A1 * 1/2011 Michiwaki ..... B65D 41/0485 220/260
2011/0107878 A1 5/2011 Gust
2011/0297706 A1 * 12/2011 Zoss ..... B65D 39/0029 222/567
2013/0048592 A1 2/2013 Carley
2013/0248531 A1 * 9/2013 Lane ..... A45C 11/20 220/262
2016/0023875 A1 * 1/2016 Lenig ..... B67B 7/16 53/492

OTHER PUBLICATIONS

Applicant search methodology from related design U.S. Appl. No. 29/535,997.

* cited by examiner

BOTTLE CAP WITH INTEGRATED BOTTLE OPENER

CROSS-REFERENCE TO RELATED APPLICATIONS

This application is related to allowed U.S. Design Patent Application 29/535,997, filed Aug. 12, 2015.

This application is related to pending U.S. Design patent application Ser. No. 29/557,452, filed Mar. 9, 2016, which is a divisional application of allowed U.S. Design patent application Ser. No. 29/535,997, filed Aug. 12, 2015.

This application is related to pending U.S. Design patent application Ser. No. 29/557,456, filed Mar. 9, 2016, which is a divisional application of allowed U.S. Design patent application Ser. No. 29/535,997, filed Aug. 12, 2015.

FIELD

The field of the disclosure is related to bottle caps in general and bottle caps having integrated bottle openers, in specific.

BACKGROUND

Beer and soft drink bottles usually have tightly crimped bottle caps. These bottle caps are typically either pop-off or twist-off caps. The removal of the bottle cap requires a significant amount of force, which a person with normal strength would find difficult to remove by hand. More so, some individuals with hand problems may find it too painful to remove a bottle cap without mechanical assistance, such as by using a bottle cap opener. Often, make-shift items, such as keys, screwdrivers, lighters, or currency coins, are used to assist in opening bottle caps. The use of make-shift items may lead to injury if not used correctly or for their intended use.

Furthermore, conventional bottle openers may often be misplaced or unavailable.

Therefore, there is room for improvement within the art.

BRIEF DESCRIPTION OF THE DRAWINGS

Implementations of the present technology will now be described, by way of example only, with reference to the FIGURES.

DETAILED DESCRIPTION

Figure 1A:
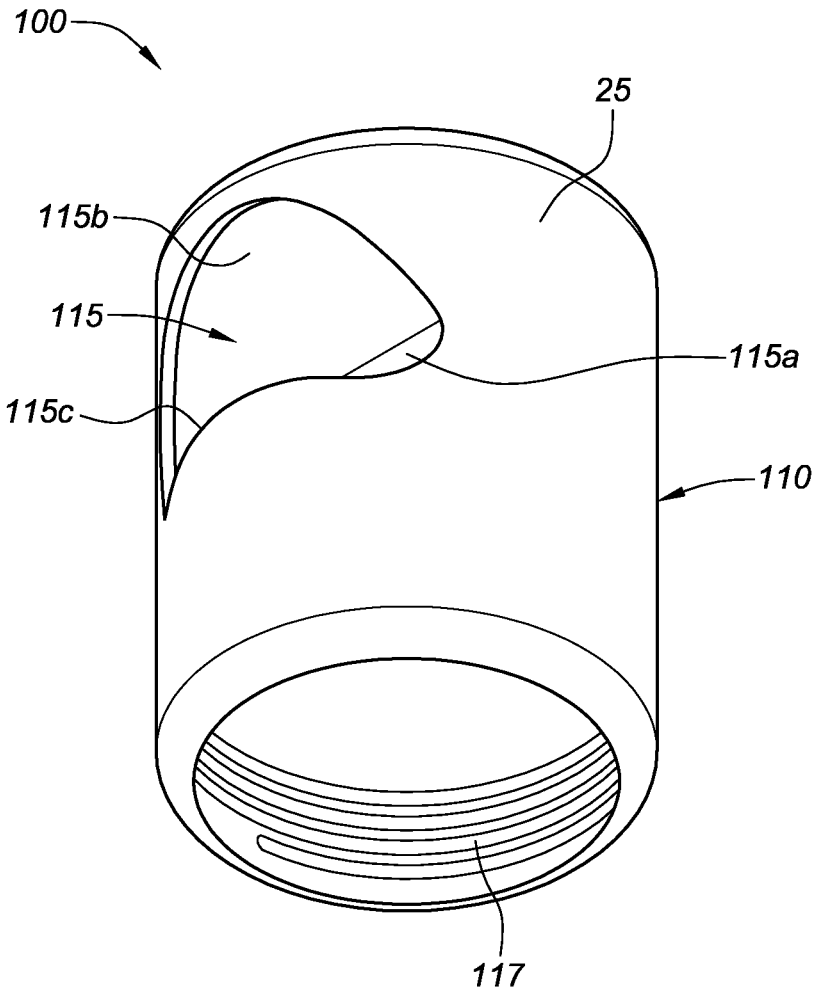
FIG. 1A is a perspective view of a first exemplary embodiment of bottle cap with an integrated bottle opener.
Figure 1B:
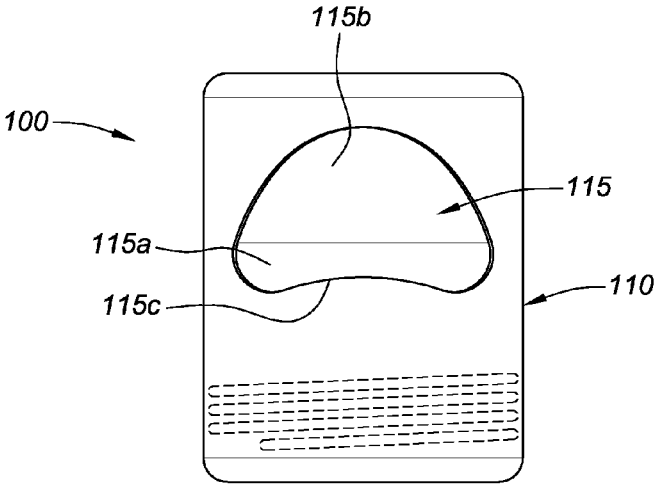
FIGS. 1B, 1C, and 1D are front and side and rear elevation views, respectively, of the exemplary bottle cap with integrated bottle opener embodiment of FIG. 1A.
Figure 1C:
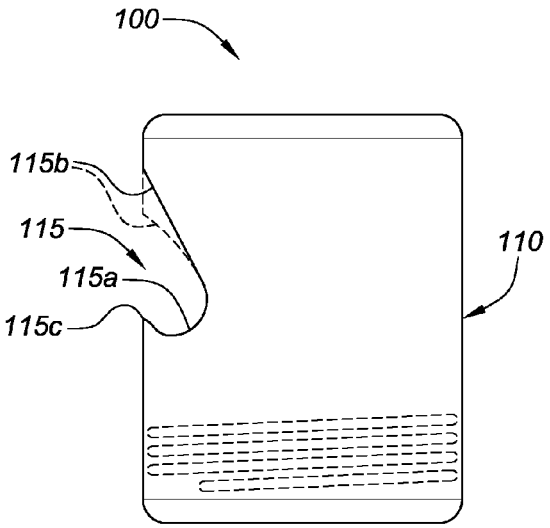
Figure 1D:
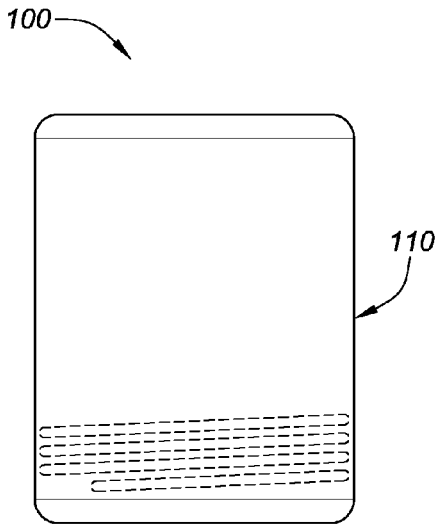

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure. Similar reference numerals are used to refer to structures similar to the various exemplary embodiments.

A first exemplary embodiment of a bottle cap with an integrated bottle opener 100 is shown in FIGS. 1A-1D.

Figure 2:
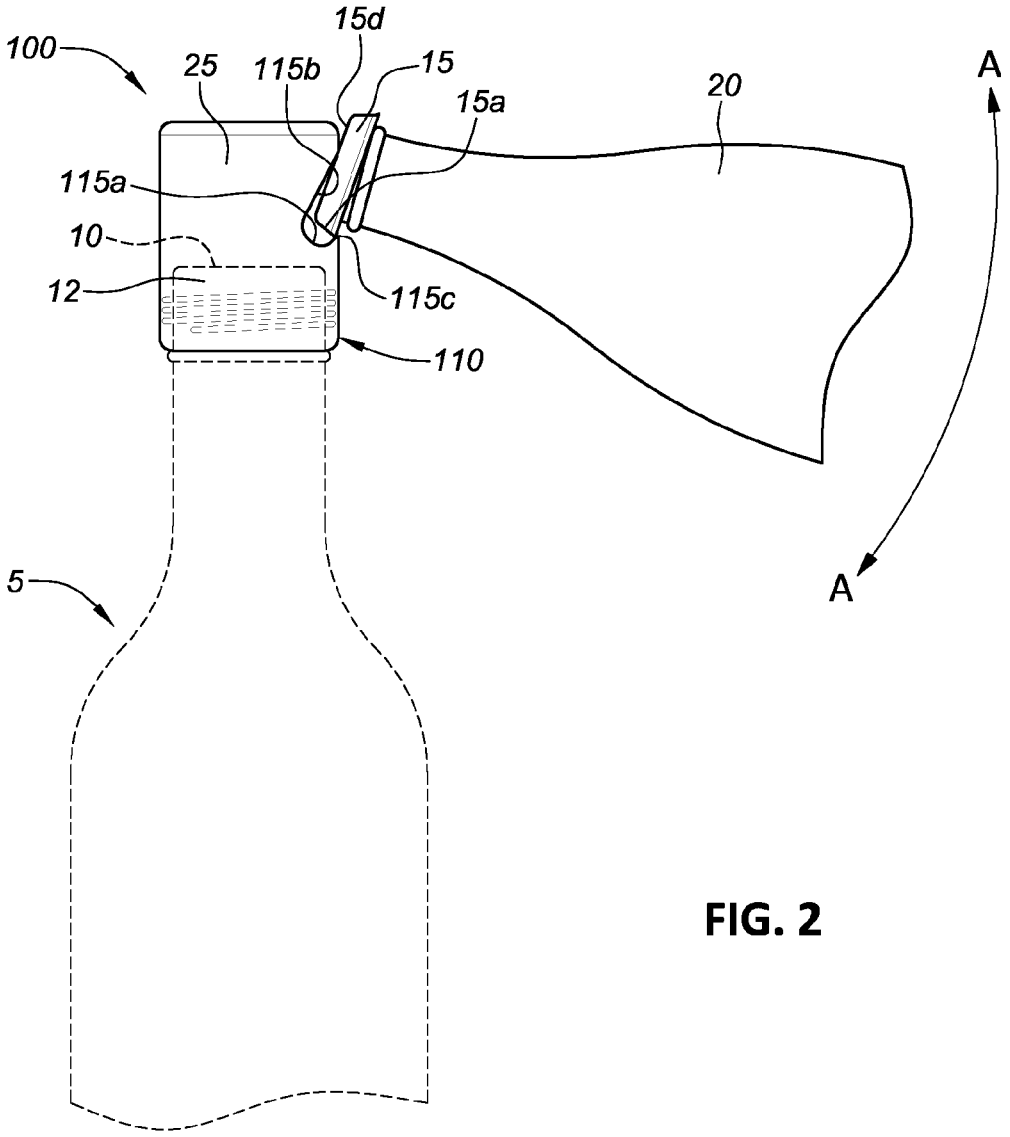
FIG. 2 depicts the exemplary embodiment of a bottle cap with integrated bottle opener of FIG. 1A being used to remove a cap from another bottle.
Figure 3A:
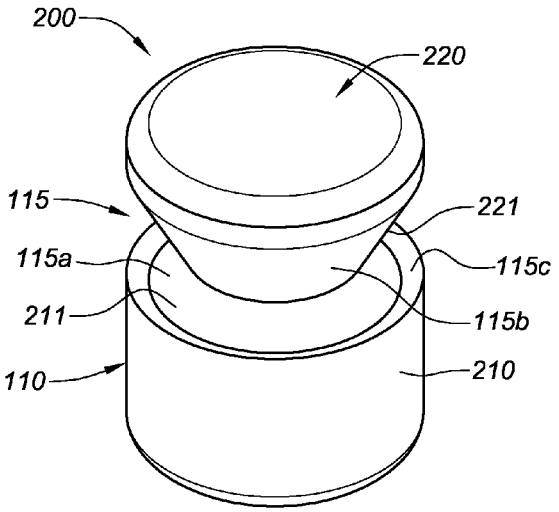
FIGS. 3A, 3B, 3C are perspective views of a second exemplary embodiment of bottle cap with an integrated bottle opener.
Figure 3B:
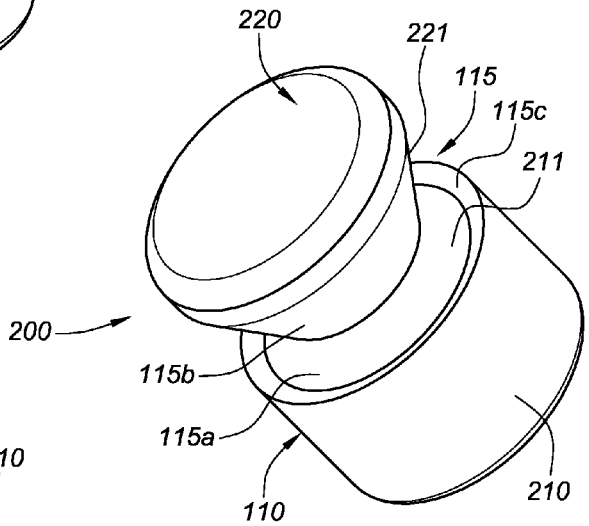
Figure 3C:
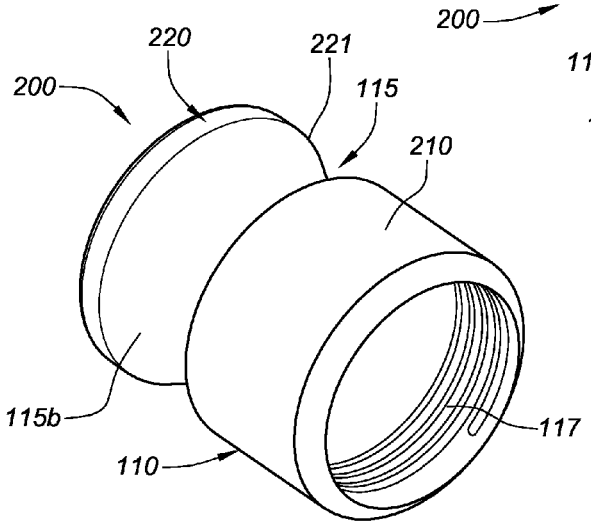
Figure 3D:
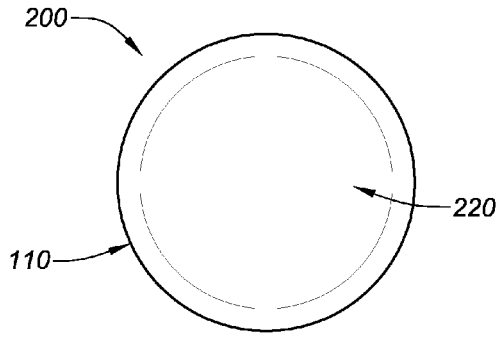
FIGS. 3D, 3E, and 3F are top plan, side elevation view, and side alternative elevation views, respectively, of the exemplary bottle cap with integrated bottle opener embodiment of FIG. 3A.
Figure 3E:
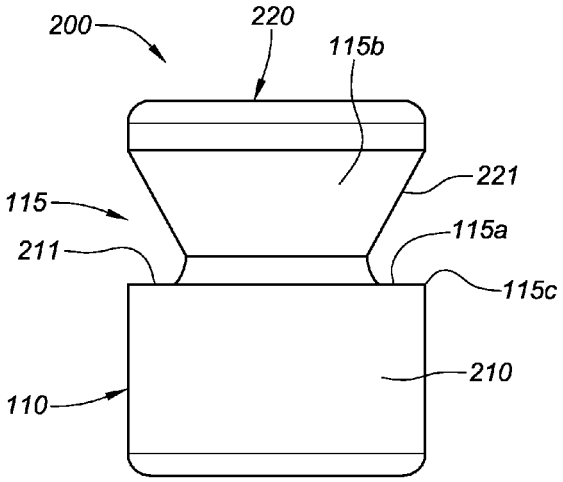
Figure 3F:
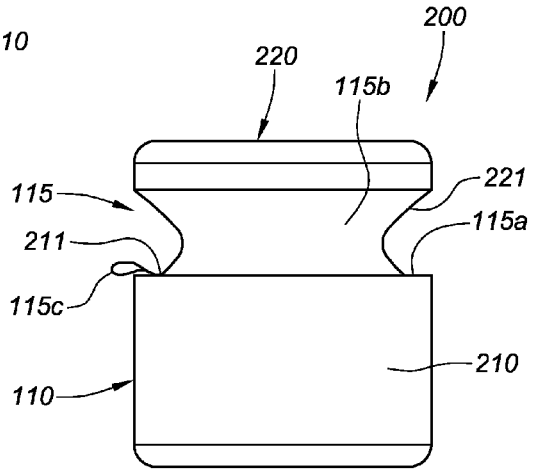

The exemplary bottle cap 100 comprises a cap body 110 for covering an opening 10 of a bottle 5, such as shown in FIG. 2. While any commonly used tamper-proof devices may be used with bottle cap 100, they are not shown herein. The cap body 110 has a bottle opener 115 integrally formed into the cap body 110 for removing a cap 15 from another bottle 20. Cap body 110 typically comprises a cylindrical outer surface 25 and the bottle opener 115 may be formed as a groove in at least a portion of the outer surface 25. The groove may be located at any vertical position between the top of cap body 110 and the bottom of cap body 110. The cap body 110 may be made of any material able to withstand the mechanical forces resulting from the prying off of the bottle cap 15. For example, cap body 110 may be made of metal, wood, resin, hard plastic/thermoplastic, or any food-grade material.

As shown in FIG. 2, cap 15 to be removed is a conventional crimped, twist-off or snap-off cap and therefore the bottle opener is a twist-off or snap-off type bottle opener.

Cap body 110 firmly connects to the bottle cap 100 to the bottle 5. For example, cap body 100 may have threads 117 for cooperating with threads 12 of its associated bottle 5 or a press-fit structure (not shown) firmly connects the bottle cap 100 to the bottle 5.

Bottle opener 115 may comprise a groove formed as: a depression or well 115*a* for receiving a lower portion of the bottle cap 15 to be removed; an engagement surface 115*b*, preferably formed as a sloping planar or curved surface (see comparison in FIG. 1C) for contacting the bottle cap 15 to be removed; and a hook 115*c* for retaining a rim or edge 15*a* of the cap 15 to be removed. Top surface 15*d* of the cap 15 to be removed acts as a leverage point (or fulcrum) in combination with engagement surface 115*b*.

To remove cap 15, cap 15 is inserted into bottle opener 115, cap 15 is engaged by hook 115*c*. Then, one or both, of bottle 5 and 20 are moved relative to each other in the direction of arrow A-A of FIG. 2. During removal, top surface 15*d* of the cap 15 to be removed acts as a leverage point (or fulcrum) in combination with engagement surface 115*b*.

As shown in FIG. 2, bottle cap 100 need not be removed to access bottle opener 115 and cap 15 may be removed from another bottle 20 while cap body 110 is covering the opening 10 of its associated bottle 5.

FIGS. 3A-3F show second and second alternative exemplary embodiments of the bottle cap with integrated bottle opener 200.

As shown in FIGS. 3A-3F, in bottle cap 200, bottle opener 115 spans the entire perimeter of the cap body 110. In particular, the groove forming the bottle opener 115 is circular and may encircle the entire cap body 110.

In this second exemplary embodiment, the cap body 110 comprises: a first cap body portion 210 and a second cap body portion 220. The first cap body portion 210 is cylindrical and having an upper portion 211. Depression or well 115*a* surrounded by hook 115*c* is located in upper portion 211. The second cap body portion 220 is an inverted substantially frustoconical body having conical surfaces 221. The conical surfaces 221 of the second cap body portion act as the engagement surface 115*b*. The bottle opener groove 115 comprises a space between the well 115*a* of the first cap body portion 210 and the top of the second cap body portion 220.

To remove cap 15 using bottle cap 200 with integrated bottle opener, the same procedure as shown in FIG. 2 is carried out. Due to the fact that bottle opener groove 115 of the second exemplary embodiment is circular, alignment of cap body 110 to a particular position to open bottle cap 15 is not required. The bottle cap 15 can be removed using any part of the perimeter of bottle opener groove 115.

FIGS. 4A-4E show a third exemplary embodiment of the bottle cap with integrated bottle opener 300.

As shown in FIGS. 4A-4D, bottle cap 300, besides for having bottle opener 115 integrally formed therein, includes a flow channel 310 there through for allowing material to be poured from the bottle 5 without having to remove the bottle cap 300 from the bottle 5.

Figure 4A:
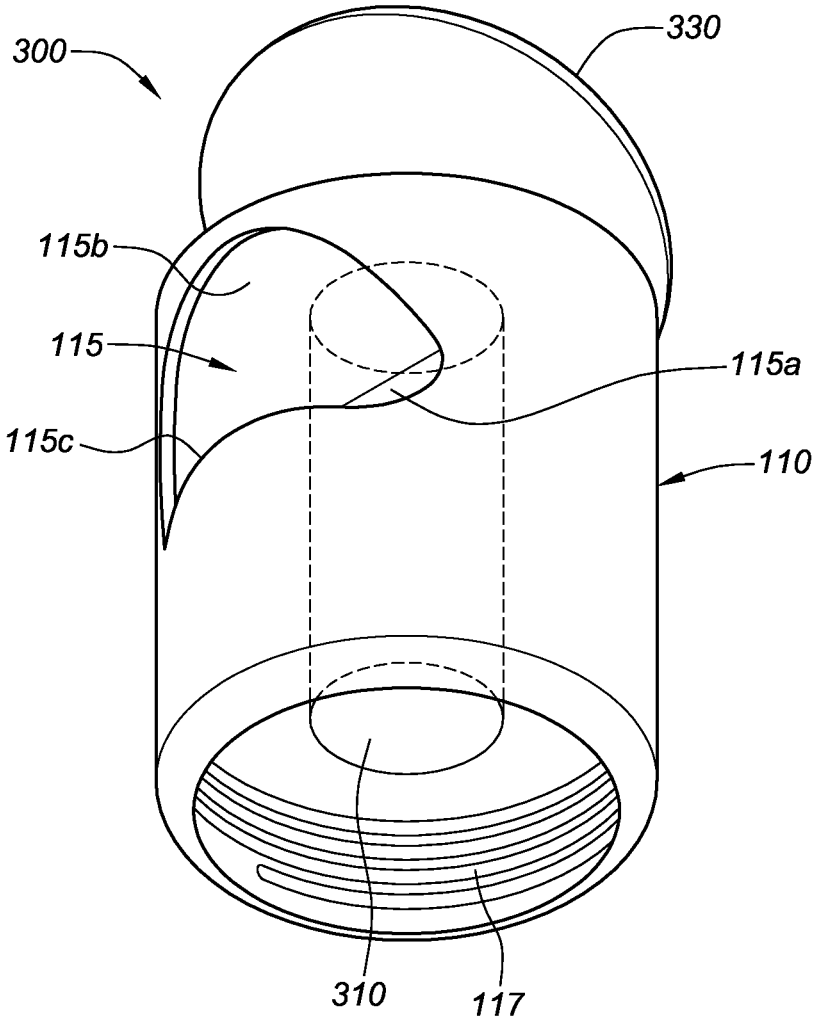
FIG. 4A is a perspective view of a third exemplary embodiment of bottle cap with an integrated bottle opener.
Figure 4B:
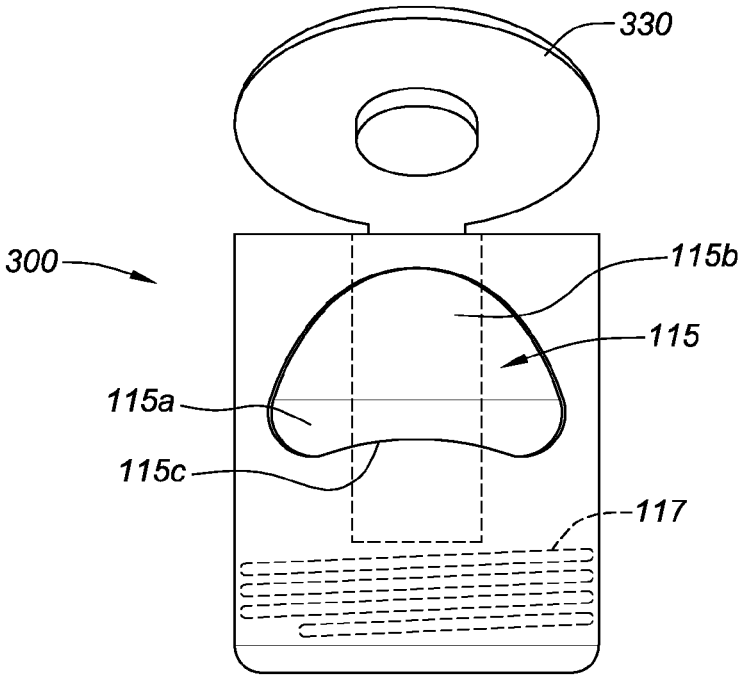
FIGS. 4B, 4C, 4D, and 4E are front, side, rear, and side (alternative) elevation views, respectively, of the exemplary bottle cap with integrated bottle opener embodiment of FIG. 4A.
Figure 4C:
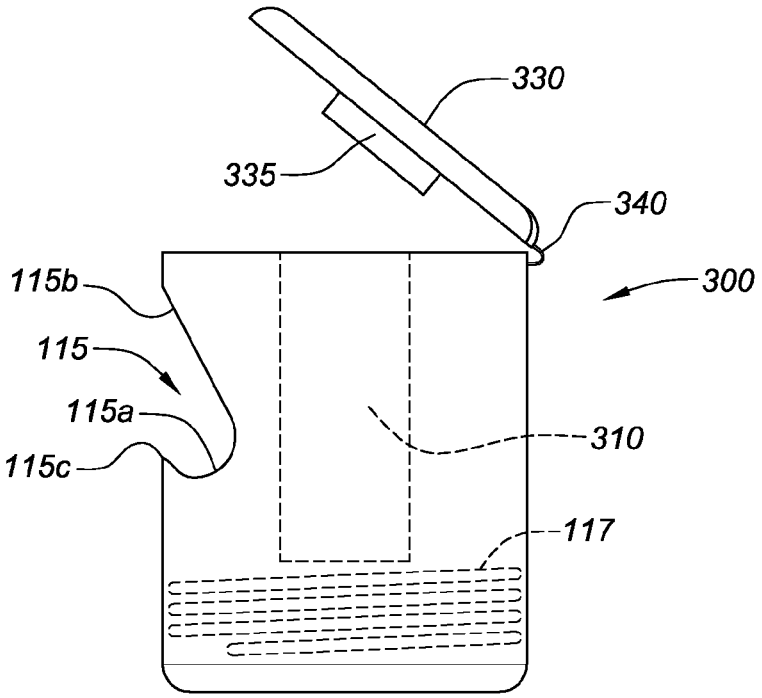
Figure 4D:
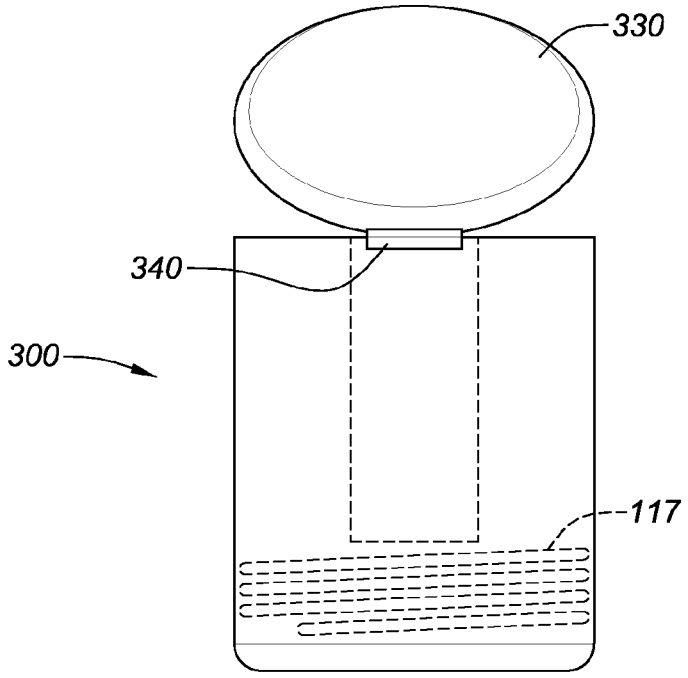
Figure 4E:
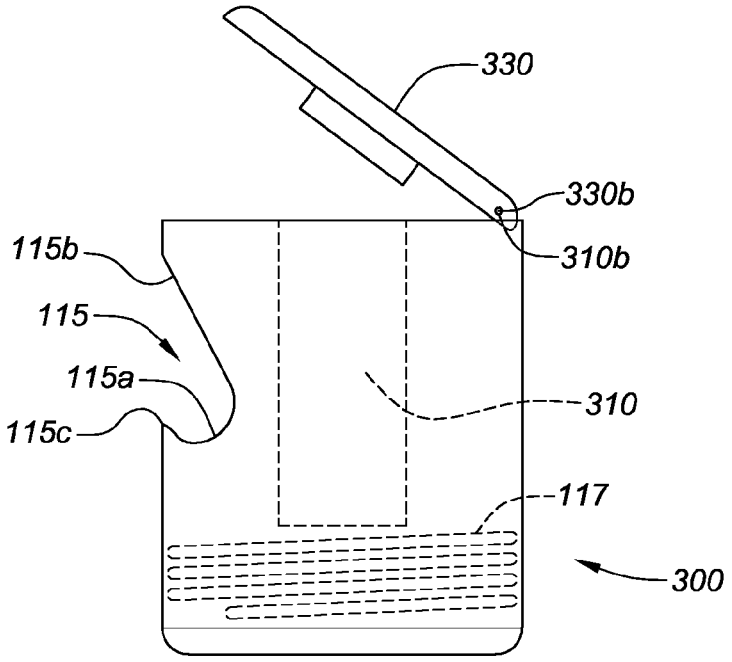

In the exemplary embodiment of FIGS. 4A-4D, the cap body 110 further comprises a movable top 330 for covering or uncovering the flow channel 310 and forming the top of the cap body 110. The underside of movable top 330 may have a plug 335 (FIG. 4C and FIG. 4E) for sealing the flow channel 310 and assist in retaining the movable top 330 in the closed position. Movable top 330 may move to or from the open and closed positions by use of any type of hinge. For example, as shown in FIGS. 4C and 4D, the hinge may comprise a living hinge 340 made of an elastic or other flexible material. Alternatively, as shown in FIG. 4E, the hinge may comprise a mechanical hinge having a pin 330*b* associated with the top 330 and a pin hole 310*b* associated with the cap body 110. Cap body 110 and movable top 330 may have a finger/nail catch structure (not shown) to assist in latching the top 330 closed and assist in a user opening movable top 330.

To remove cap 15 using bottle cap 300 with integrated bottle opener, the same procedure as shown in FIG. 2 is carried out.

Figure 5:
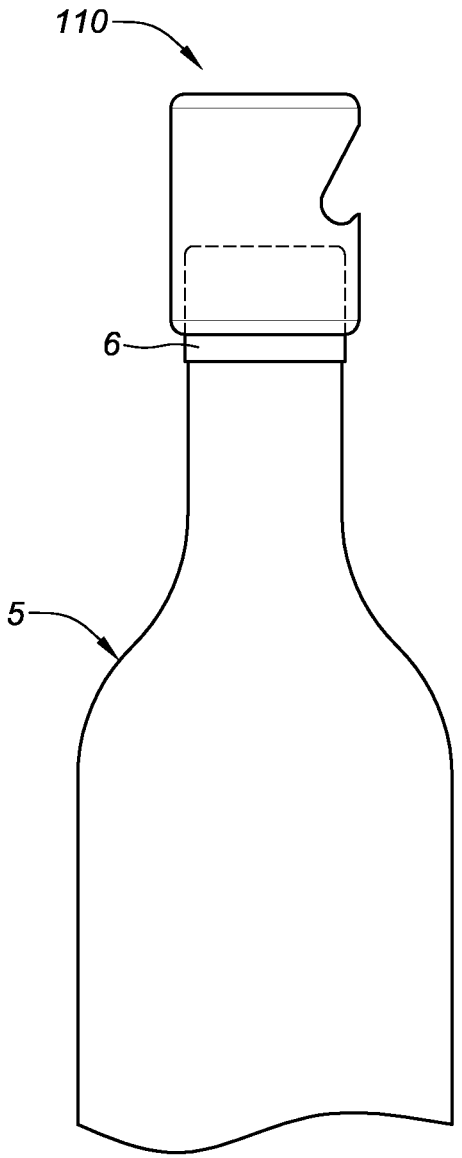
FIG. 5 shows a simplified side elevation view of another exemplary embodiment of the bottle cap with integrated bottle opener.

FIG. 5 shows a simplified side elevation view of another exemplary embodiment of the bottle cap with integrated bottle opener. In this embodiment, bottle 5 has a cover 6. Cap body 110 has a sleeve-like structure that receives cover 6. Cover 6 and cap body 110 may be joined by any method, such as glue, epoxy, or press-fit.

The various exemplary embodiments are convenient to use because their integral bottle openers are accessible even when the cap body covers the opening of the bottle. In other words, as opposed to bottle openers shown in, for example, U.S. Design Pat. D653,512, removal of the bottle cap from its associated bottle is not required to access or use the bottle cap opener.

Advantages of having a bottle cap with an integrated bottle opener can be seen in various situations.

One example is when the cap with an integrated bottle opener is fastened to a beverage bottle containing a beer mix such as a Bloody Mary mix. The integrated bottle opener embodiment's convenient location on top of such beverage bottle allows for easy finding. This reduces the amount of time lost in trying to find a bottle opener. Also, since the liquid content is a complement to beer, it's highly likely to find both the mix and beer located near each other or reasonably near one another due to their complementing uses. Possible locations of such invention embodiment when attached to a beer mix beverage bottle are in an ice chest, refrigerator or on top of a table/shelf. This permits convenience of use. For example, when a user desires to add beer mix to his/her beer, a consumer may simply utilize any of the disclosed exemplary embodiments to remove the twist off or pop off beer bottle cap. Further noting, that both items will be in close proximity with each other, also maximizes the use of a beverage bottle utilizing such invention embodiment.

Other potential benefits of the exemplary embodiments of the bottle caps with integrated bottle openers described herein may include: the bottle cap can serve multiple purposes, such as bottle cap and bottle cap opener; being simple, compact and economical to manufacture; conveniently located to assist in opening bottles; optimizes use of a bottle cap by providing it with additional functions; reduces environmental impact because of multiple uses and when applicable, recyclable materials; and bottle leverage improves ease of use with less force required to open bottled beverages.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in decorative and structural matters of shape, size and arrangement of the parts within the principles of the present disclosure up to, and including the full extent established by the broad general meaning of the terms used in the claims. It will therefore be appreciated that the embodiments described above may be modified within the scope of the claims.

That which is claimed:

1. A multi-function bottle cap with integrated bottle opener for covering an opening of a first associated bottle and opening a second associated bottle, the bottle openings having an opening surrounded by a neck, the opener comprising:

a cap body for spanning over the opening of the first associated bottle and also at least partially surrounding the neck of the first associated bottle; and a bottle opener formed entirely within the cap body, the bottle opener for removing a bottle cap from another bottle while the cap body continues to cover the opening of its associated bottle; the cap body covering the opening until contents of the associated bottle are to be accessed; wherein to access the contents, the cap body is removed from covering the opening;

wherein the cap body is removable from its position spanning over the opening to allow contents to be removed from the bottle;

wherein the cap body replaceable to its position spanning over the opening to the first associated bottle and at least partially surrounding the neck of the first associated bottle to prevent contents from being leaked from inside the associated bottle again;

wherein the cap body comprises an outer surface and the bottle opener is formed as a groove in a portion of the outer surface;

wherein the groove of the bottle opener spans the entire perimeter of the cap body and comprises:

a well for receiving a portion of the bottle cap to be removed;

an engagement surface for contacting another portion of the bottle cap to be removed; and a hook for retaining the edge of the cap to be removed when one or both, of the bottles are moved relative to each other to remove the bottle cap to be removed; and wherein the cap body further comprises at least a first cap body portion, the first cap body portion is substantially cylindrical and has an inner sidewall, the first cap body portion having threads on the inner sidewall, and the threads tighten to seal the contents in the associated bottle.

2. The bottle cap of claim 1, wherein the engagement surface comprises a planar surface.

3. The bottle cap of claim 1, wherein the engagement surface comprises a curved or arcuate surface.

4. The bottle cap of claim 1, wherein the cap to be removed from the second associated bottle is a crimped cap, a twist-off cap or a snap-off cap.

5. The bottle cap of claim 1, wherein the outer surface is cylindrical and the groove is circular.

6. The bottle cap of claim 1, wherein the cap body further comprises:

a second cap body portion; wherein:

the first cap body portion has an upper portion; the well located in the upper portion, the well surrounded by a hook; and the second cap body portion is an inverted substantially frustoconical body having a circular top portion and conical surface portions, the bottle opener groove comprising a space between the well of the first cap body portion and the circular top portion of the second cap body portion.

7. A multi-function bottle cap with integrated bottle opener for covering an opening of a first associated bottle and opening a second associated bottle, the bottle openings having an opening surrounded by a neck, the opener comprising:

a cap body for spanning over the opening of the first associated bottle and also at least partially surrounding the neck of the first associated bottle; and a bottle opener formed entirely within the cap body, the bottle opener for removing a bottle cap from another bottle while the cap body continues to cover the opening of its associated bottle; the cap body covering the opening until contents of the associated bottle are to be accessed; wherein to access the contents, the cap body is removed from covering the opening;

wherein the cap body is removable from its position spanning over the opening to allow contents to be removed from the bottle;

wherein the cap body replaceable to its position spanning over the opening to the first associated bottle and at least partially surrounding the neck of the first associated bottle to prevent contents from being leaked from inside the associated bottle again;

wherein the cap body comprises an outer surface and the bottle opener is formed as a groove in a portion of the outer surface;

wherein the groove of the bottle opener comprises:

a well for receiving a portion of the bottle cap to be removed;

an engagement surface for contacting another portion of the bottle cap to be removed; and a hook for retaining the edge of the cap to be removed when one or both, of the bottles are moved relative to each other to remove the bottle cap to be removed; and wherein the cap body further comprises at least a first cap body portion, the first cap body portion is substantially cylindrical and has an inner sidewall, the first cap body portion having threads on the inner sidewall, and the threads tighten to seal the contents in the associated bottle, wherein the cap body has a flow channel there through for allowing material to be poured from the bottle without having to remove the cap body from the bottle.

8. The bottle cap of claim 7, wherein the cap body further comprises a movable top for covering or uncovering the flow channel and forming the top of the bottle cap.

9. The bottle cap of claim 8, wherein the movable top is associated with the cap body by a hinge.

10. The bottle cap of claim 9, wherein the hinge is an elastic living hinge.

11. The bottle cap of claim 9, wherein the hinge comprises a pin and hole hinge.

12. The bottle cap of claim 8, wherein an underside of the movable top has a plug for interacting with the flow channel.

* * * * *